US007293857B2

(12) United States Patent
Beak

(10) Patent No.: US 7,293,857 B2
(45) Date of Patent: Nov. 13, 2007

(54) INKJET PRINTHEAD AND METHOD OF MANUFACTURING THE SAME

(75) Inventor: O-hyun Beak, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 210 days.

(21) Appl. No.: 10/994,477

(22) Filed: Nov. 23, 2004

(65) Prior Publication Data

US 2005/0168534 A1 Aug. 4, 2005

(30) Foreign Application Priority Data

Jan. 29, 2004 (KR) ..... 10-2004-0005635

(51) Int. Cl.
*B41J 2/05* (2006.01)

(52) U.S. Cl. ..... 347/58; 347/59

(58) Field of Classification Search ..... 347/56–59, 347/61–65, 67

See application file for complete search history.

(56) References Cited

U.S. PATENT DOCUMENTS 5,517,224 A 5/1996 Kaizu et al. ..... 347/59
6,315,396 B1 11/2001 Ozaki et al. ..... 347/60
6,536,877 B2 * 3/2003 Miyamoto et al. ..... 347/58
6,848,772 B2 * 2/2005 Kim ..... 347/63
2002/0126182 A1 9/2002 Miyamoto ..... 347/63

FOREIGN PATENT DOCUMENTS

JP 2000-108355 4/2000
JP 2001-212995 8/2001
JP 2002-307683 10/2002
KR 2001-0111375 A 12/2001

* cited by examiner

*Primary Examiner*—Juanita D. Stephens
(74) *Attorney, Agent, or Firm*—Roylance, Abrams, Berdo & Goodman, L.L.P.

(57) ABSTRACT

An inkjet printhead and a method of manufacturing the same are provided. The inkjet printhead includes a substrate; a plurality of heaters formed on an upper portion of the substrate for heating ink for generating bubbles; a plurality of metal-oxide semiconductor (MOS) field effect transistors (FETs) formed on the substrate for addressing the heaters and applying electric current to the heaters; first, second, and third interconnecting layers that are sequentially formed on the MOS FETs and electrically connected to each other for applying signals to the MOS FETs; a chamber layer for defining an ink chamber, which is filled with ink for ejection, on an upper portion of the heaters; and a nozzle layer having a nozzle, through which the ink is ejected, on an upper portion of the chamber layer.

10 Claims, 15 Drawing Sheets

INKJET PRINTHEAD AND METHOD OF MANUFACTURING THE SAME

BACKGROUND OF THE INVENTION

This application claims the benefit under 35 U.S.C. § 119(a) of Korean Patent Application No. 2004-5635, filed on Jan. 29, 2004, in the Korean Intellectual Property Office, the entire contents of which are incorporated herein by reference.

1. Field of the Invention

The present invention relates to an inkjet printhead and a method of manufacturing the same. More particularly, the present invention relates to an inkjet printhead and a method of manufacturing the same by which a size of a chip of a printhead can be minimized and a transmission speed of a circuit signal can be increased.

2. Description of the Related Art

An inkjet printhead is a device that ejects fine droplets of an ink having predetermined colors onto desired positions of a recording medium in order to print an image. Inkjet printheads can be classified into two types according to an ink droplet ejecting mechanism. One of the types is a thermally driven inkjet printhead that generates bubbles in the ink using a thermal source and ejects ink droplets when the bubbles expand. The other type is a piezoelectrically driven inkjet printhead that utilizes the deformation of a piezoelectric material to eject ink droplets.

The ink droplet ejecting mechanism of the thermally driven inkjet printhead will now be described in detail. When a pulse of electric current flows through a heater formed of a resistive heating material, the heater generates heat which instantaneously raises the temperature of ink adjacent to the heater up to 300° C. Accordingly, the ink boils and generates bubbles which expand to press the ink filling an ink chamber. Ink adjacent to a nozzle is ejected from the ink chamber through the nozzle as a droplet.

In addition, the thermally driven inkjet printhead can be divided into a top-shooting type, a side-shooting type, and a back-shooting type according to the direction of growth of the bubble and the direction of ejection of the ink droplet. In the top-shooting type of printhead, the direction of growth of the bubble and the direction of ejection of the ink droplet are the same. In the side-shooting type of printhead, the direction of growth of the bubble and the direction of ejection of the ink droplet are perpendicular to each other. In the back-shooting type of printhead, the direction of growth of the bubble and the direction of ejection of the ink droplet are opposite to each other.

The thermally driven inkjet printhead should satisfy the following conditions. First, the inkjet printhead should be manufactured by simple processes at low cost, and should be able to be mass-produced. Second, in order to obtain a high definition image, cross talk between adjacent nozzles should be restrained, and an interval between adjacent nozzles should be formed as narrowly as possible. That is, a plurality of nozzles should be arranged very densely in order to increase a value of dots per inch (DPI). Third, in order to perform a high-speed printing operation, an operation of refilling the ink chamber with ink after an ejection should be performed within a short period. This amounts to a requirement that cooling of the heated ink and the heater be performed rapidly, in order to increase the driving frequency.

Recently, an inkjet printhead having hundreds of nozzles with reduced sizes has been developed for obtaining a clear image quality and high-speed printing.

FIG. 1 is a plan view showing a conventional thermally driven inkjet printhead, and FIG. 2 shows a driving circuit of the printhead.

Referring to FIGS. 1 and 2, the thermally driven inkjet printhead includes a plurality of heaters 60 for heating ink to generate bubbles, a heater driving circuit 41 that drives the heaters 60, a digital logic circuit 31 for addressing the heaters 60, and connection pads 15. Here, the heater driving circuit 41 includes a plurality of power field effect transistors (FETs) 40 formed to correspond to each of the heaters 60, and interconnecting layers that are electrically connected to the power FETs 40. The digital logic circuit 31 includes a plurality of complementary metal-oxide semiconductor (CMOS) FETs and interconnecting layers connected to the CMOS FETs.

The heaters 60 are arranged in a center portion of the printhead in two rows, the heater driving circuit 41 is disposed around the heaters 60, and address lines 35 that supply signals to gates of the power FETs 40 are formed at an outer portion of the heater driving circuit 41. The digital logic circuit 31 is disposed near the connection pads 15.

FIG. 3 shows a vertical structure of the conventional thermally driven inkjet printhead.

Referring to FIG. 3, MOS FETs 30 and 40 that address the heaters 60 for heating the ink and apply electric current to the heaters 60 are formed on a substrate 10. The MOS FETs 30 and 40 include a CMOS FET 30 for forming the digital logic circuit 31 (see FIG. 1) and a power FET 40 for forming the heater driving circuit 41 (see FIG. 1). Here, the CMOS FET 30 includes a P-channel MOS (PMOS) FET 30*a* and an N-channel MOS (NMOS) FET 30*b*, and the power FET 40 preferably includes an N-MOS FET. In the drawings, reference numeral 20 denotes a field oxide film, 21 denotes a gate oxide film, and 23 denotes a gate.

In addition, a first interconnecting layer 51 and a second interconnecting layer 53, which are made of a metal having a high ejection conductivity, are sequentially stacked on the upper portion of the MOS FETs 30 and 40, thereby forming the digital logic circuit 31 and the heater driving circuit 41. Here, the first interconnecting layer 51 is connected to source and drain regions of the FET through a contact hole 27, and the second interconnecting layer 53 is electrically connected to the first interconnecting layer 51 through a via hole (not shown). In the drawings, references numerals 22 and 24 respectively denote first and second inter-layer dielectrics.

The heater 60 for heating the ink is formed between the second interconnecting layer 53 and the second inter-layer dielectric 24 on the upper portion of the power FET 40, and a passivation layer 28 is formed on the heater 60 and the second interconnecting layer 53. The passivation layer 28 insulates the heater 60 from the ink, and prevents the heater 60 from being corroded by the ink. A chamber layer 70 that defines an ink chamber 75, which is filled with the ink, and a nozzle layer 80, on which a nozzle 85 for ejecting the ink is formed, are sequentially formed on the passivation layer 28.

As described above, in the conventional thermally driven inkjet printhead, the two interconnecting layers 51 and 53 are sequentially stacked on the upper portion of the MOS FET 30 and 40 to form the digital logic circuit 31 and the heater driving circuit 41. And, the address line 35 that is an output line of the digital logic circuit 31 is located at an outer portion of the heater driving circuit 41. Consequently, the printhead chip is quite large and expensive to manufacture. In addition, it is difficult to arrange additional wires. Moreover, since the lengths of the wires increase, the circuit signal transmission speed is lowered.

SUMMARY OF THE INVENTION

The present invention provides an inkjet printhead and a method of manufacturing the same, by which a printhead chip size can be minimized and a circuit signal transmission speed can be increased using three metal interconnecting layers.

According to an aspect of the present invention, an inkjet printhead including a substrate is provided. The substrate comprises a plurality of heaters formed on an upper portion of the substrate for heating ink to generate bubbles, a plurality of metal-oxide semiconductor (MOS) field effect transistors (FETs) formed on the substrate to address the heaters and apply electric current to the heaters, a first interconnecting layer, a second interconnecting layer, and a third interconnecting layer that are sequentially formed on the MOS FETs and are electrically connected to each other to apply signals to the MOS FETs, a chamber layer that defines an ink chamber, which is filled with the ink that will be ejected, on an upper portion of the heaters, and a nozzle layer having a nozzle, through which the ink is ejected, on an upper portion of the chamber layer.

The heaters may be formed on a lower surface of the third interconnecting layer, that is, a top interconnecting layer.

First, second, and third interlayer dielectrics may be formed between the MOS FETs, and the first, the second, and the third interconnecting layers. The first, second, and third interlayer dielectrics may comprise $SiO_2$ or boron phosphorous silicate glass. Here, the heaters may be formed between the third interconnecting layer and the third interlayer dielectric.

The heaters may comprise TaAl, TaN, or TiN.

A passivation layer may be formed on upper surfaces of the heaters and the third interconnecting layer, and the passivation layer may comprise SiN.

An anti-cavitation layer may be formed on an upper surface of the passivation layer, on which the ink chamber is located, and the anti-cavitation layer may comprise Ta, Ti, or TiN.

According to another aspect of the present invention, a method of manufacturing an inkjet printhead is provided. The method comprises forming a plurality of MOS FETs on a surface of a substrate; forming first, second, and third interconnecting layers for applying signals to the MOS FETs, and heaters that are driven by the MOS FETs; forming a chamber layer that defines an ink chamber, which is filled with ink that will be ejected, on an upper portion of the heaters; and forming a nozzle layer having a nozzle, through which the ink is ejected, on an upper portion of the chamber layer.

In the second step of forming, the first, second, and third interconnecting layers may be sequentially formed on the MOS FETs, and the heaters are formed on a lower surface of the third interconnecting layer.

The second step of forming further comprises forming a first interlayer dielectric on the MOS FETs, and forming the first interconnecting layer on the first interlayer dielectric, forming a second interlayer dielectric on the first interconnecting layer, and forming the second interconnecting layer on the second interlayer dielectric, forming a third interlayer dielectric on the second interconnecting layer, and forming the heaters on the third interlayer dielectric, and forming the third interconnecting layer on the heaters.

The first, second, and third interlayer dielectrics may comprise $SiO_2$ or boron phosphorous silicate glass.

Forming the first interconnecting layer comprises forming a contact hole, which exposes a source and a drain of the MOS FETs, in the first interlayer dielectric, and depositing a metal material on an upper surface of the first interlayer dielectric so as to fill the contact hole, and patterning the deposited material.

The forming the second interconnecting layer comprises forming a first via hole, which exposes a part of the first interconnecting layer, in the second interlayer dielectric, and depositing a metal material on an upper surface of the second interlayer dielectric so as to fill the first via hole, and patterning the deposited material.

The forming the heaters comprises forming a second via hole, which exposes a part of the second interconnecting layer, in the third interlayer dielectric, and depositing a resistive heating material on the third interlayer dielectric and the exposed surface of the second interconnecting layer, and patterning the deposited material.

The resistive heating material comprises TaAl, TaN, or TiN.

Forming the third interconnecting layer comprises depositing a metal material on the upper surface of the heaters and patterning the deposited material.

The method further comprises forming a passivation layer on the upper portion of the third interconnecting layer and the heaters, and the passivation layer comprises SiN.

The method further comprises forming an anti-cavitation layer on an upper surface of the passivation layer, on which the ink chamber is located, and the anti-cavitation layer comprises Ta, Ti, or TiN.

BRIEF DESCRIPTION OF THE DRAWINGS

The above and other features and advantages of the present invention will become more apparent by describing in detail exemplary embodiments thereof with reference to the accompanying drawings in which.

Throughout the drawings, it should be noted that the same or similar elements are denoted by like reference numerals.

DETAILED DESCRIPTION OF EXEMPLARY EMBODIMENTS

Figure 1:
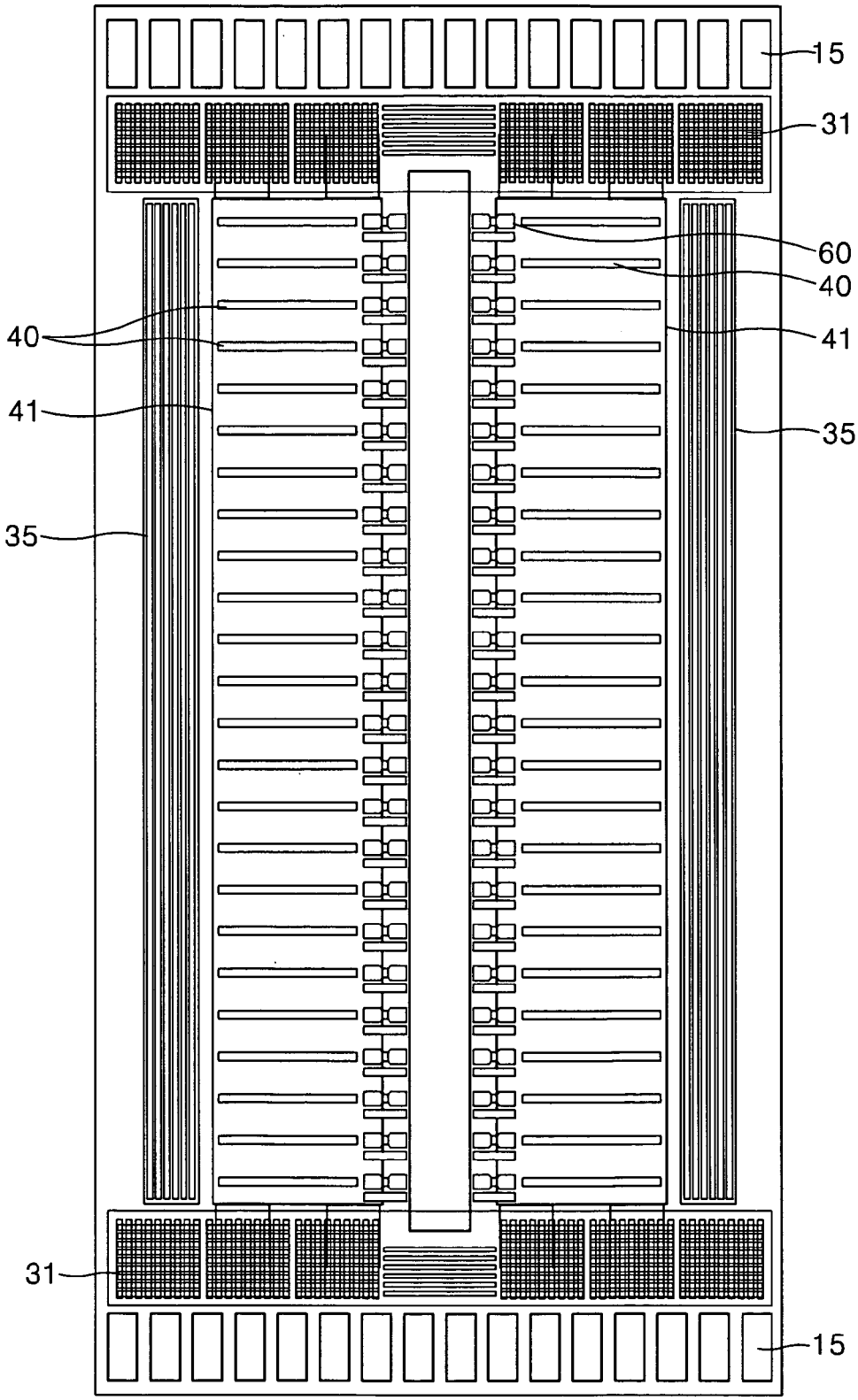
FIG. 1 (PRIOR ART)
FIG. 1 is a schematic plan view showing a conventional thermally driven inkjet printhead.
Figure 2:
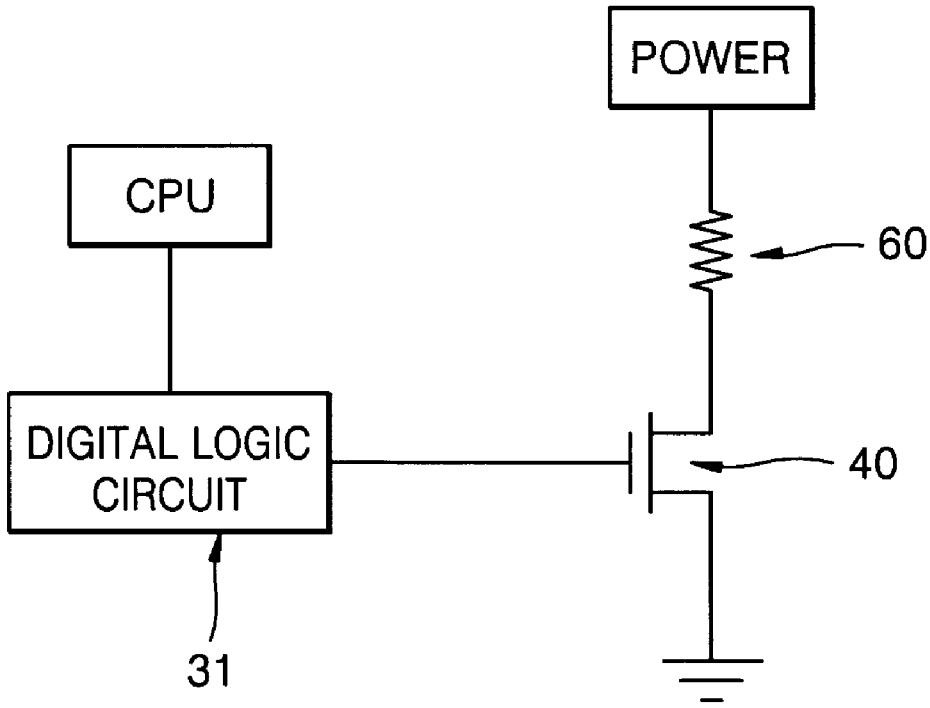
FIG. 2 (PRIOR ART)
FIG. 2 is a diagram of a driving circuit in the thermally driven inkjet printhead of FIG. 1.
Figure 3:
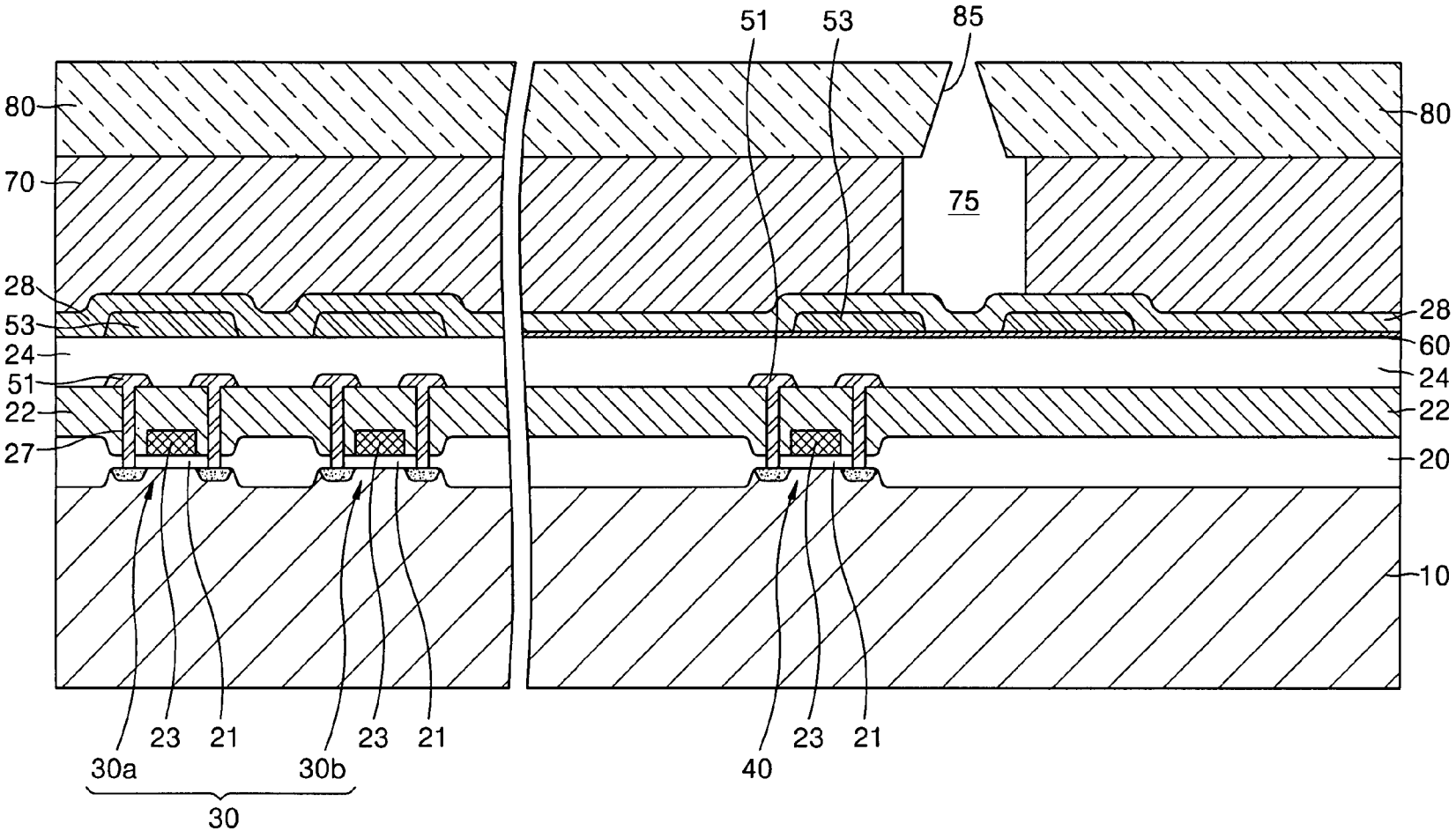
FIG. 3 (PRIOR ART)
FIG. 3 is a cross-sectional view showing a vertical structure of the inkjet printhead of FIG. 1.

The present invention will now be described more fully with reference to the accompanying drawings, in which exemplary embodiments of the invention are shown. The invention may, however, be embodied in many different forms and should not be construed as being limited to the embodiments set forth herein. In the drawings, the thicknesses of layers and regions may be exaggerated for clarity, and whenever the same element reappears in a subsequent drawing, it is denoted by the same reference numeral. Also, when a layer is said to be on a substrate or on another layer, the layer may be directly on the substrate or the other layer, or one or more other layers may be interposed therebetween.

Figure 4:
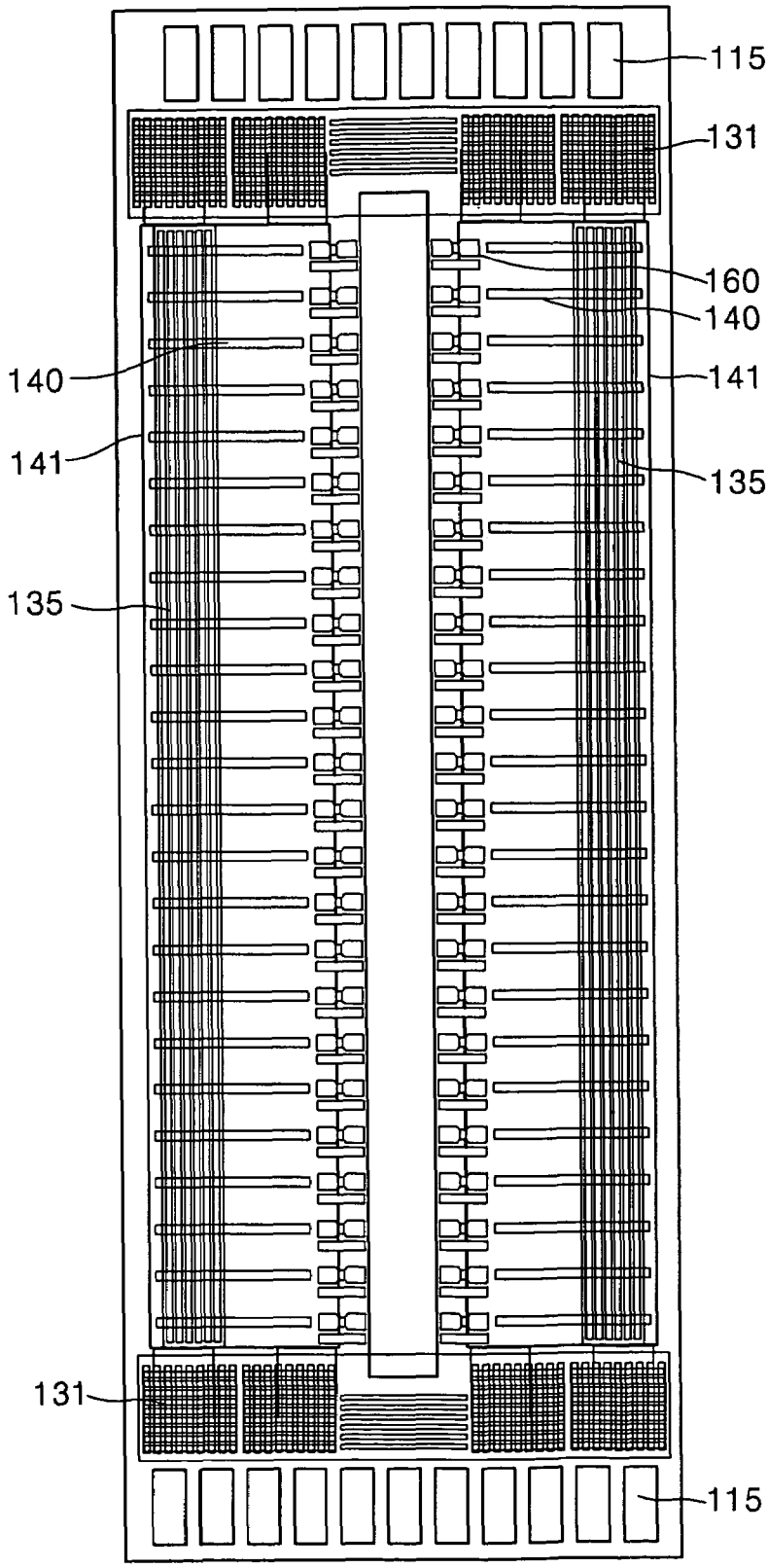
FIG. 4 is a schematic plan view showing an inkjet printhead according to an embodiment of the present invention.

FIG. 4 is a schematic plan view showing an inkjet printhead according to an embodiment of the present invention.

Referring to FIG. 4, heaters 160 for heating ink to generate bubbles are disposed at a center portion of the inkjet printhead in two rows, and a heater driving circuit 141 for driving the heaters 160 is disposed around the heaters 160. The heater driving circuit 141 includes a plurality of power field effect transistors (FETs) 140 corresponding to each of the heaters 160 and interconnecting layers that are electrically connected to the power FETs 140. Address lines 135 for supplying signals to the gates of the power FETs 140 are disposed on an upper portion of the power FETs 140. This structure can be realized by using three metal interconnecting layers, as will be described later. In addition, a digital logic circuit 131 for addressing the heaters 160 is disposed near connection pads 115. The digital logic circuit 131 includes a plurality of complementary metal-oxide semiconductor (CMOS) FETs and interconnecting layers that are electrically connected to the CMOS FETs.

Figure 5:
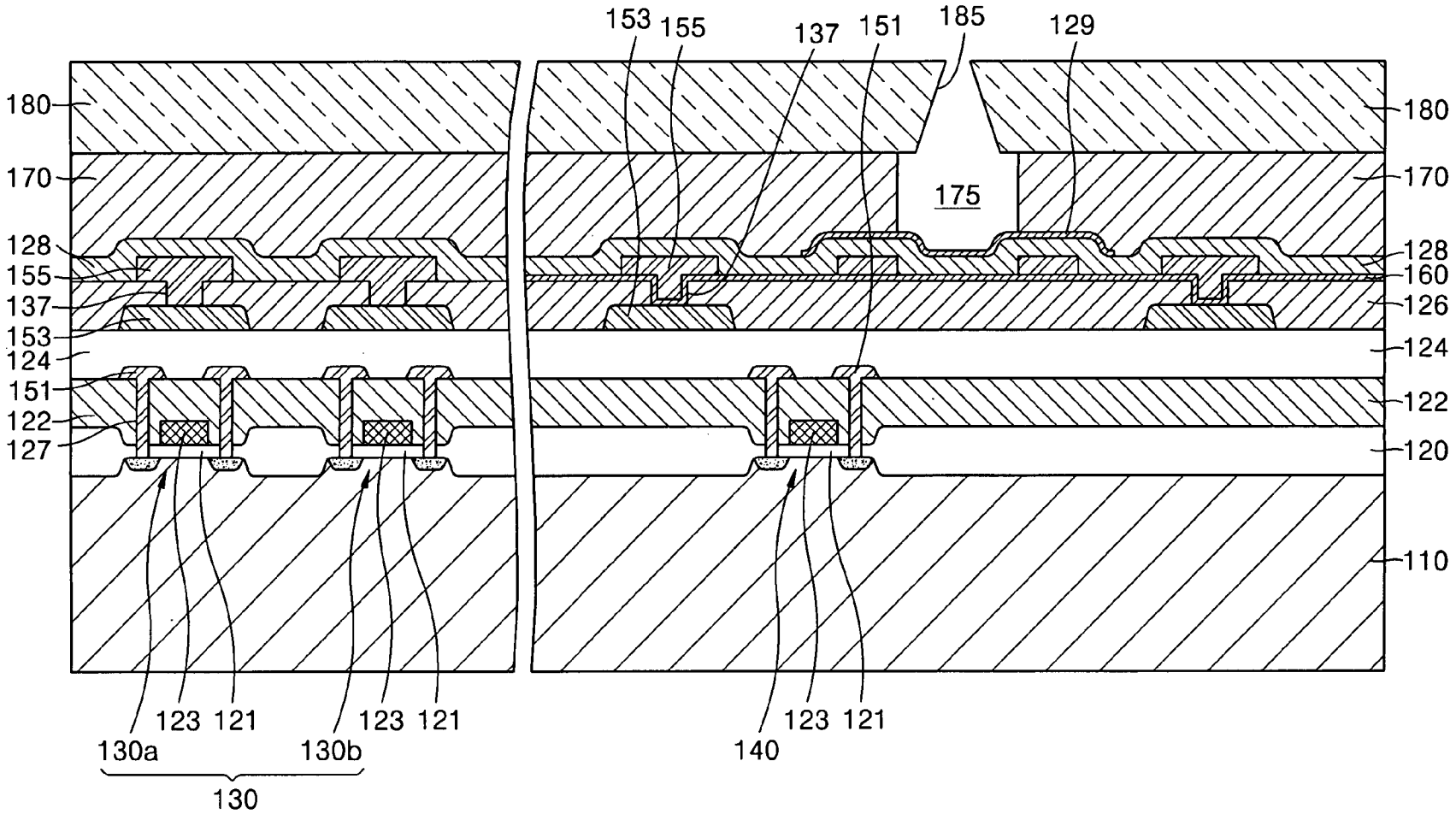
FIG. 5 is a cross-sectional view showing a vertical structure of the inkjet printhead according to an embodiment of the present invention.

FIG. 5 shows a vertical structure of the inkjet printhead according to an embodiment of the present invention.

Referring to FIG. 5, the inkjet printhead according to an embodiment of the present invention includes a substrate 110, the heaters 160 for heating the ink to generate bubbles, MOS FETs 130 and 140 for addressing the heaters 160 and applying electric current to the heaters 160, first, second, and third interconnecting layers 151, 153, and 155 for applying signals to the MOS FETs 130 and 140, a chamber layer 170 disposed on an upper portion of the heater 160 for defining an ink chamber 175, and a nozzle layer 180 disposed on an upper portion of the chamber layer 170 for ejecting ink through a nozzle 185 formed therein.

A plurality of MOS FETs 130 and 140 are formed on the substrate 110 in order to address the heaters 160 and apply electric current to the heaters 160. The MOS FETs 130 and 140 include a CMOS FET 130 for forming the digital logic circuit 131 (see FIG. 4), and a power FET 140 for forming the heater driving circuit 141 (see FIG. 4). Here, the CMOS FET 130 includes a P-channel MOS (PMOS) FET 130*a* and an N-channel MOS (NMOS) FET 130*b*, and the power FET 140 includes the NMOS FET. In the drawings, reference numeral 120 denotes a field oxide film, 121 denotes a gate oxide film, and 123 denotes a gate.

On an upper portion of the plurality of MOS FETs 130 and 140, first, second, and third interconnecting layers 151, 153, and 155, which are made of a metal having good electrical conductivity, are sequentially stacked to form the digital logic circuit 131 and the heater driving circuit 141. Here, the first, second, and third interconnecting layers 151, 153, and 155 are electrically connected to each other to apply the signals to the MOS FETs 130 and 140. Therefore, the digital logic circuit 131 can be highly integrated by forming the first, second, and third interconnecting layers 151, 153, and 155 on the upper portion of the MOS FETs 130 and 140. In addition, when the third interconnecting layer 155 formed on the upper portion of the power FET 140 is used as the address line 135 that supplies the signals to the gate 123 of the power FET 140, the size of the printhead chip can be minimized.

A first interlayer dielectric 122, a second interlayer dielectric 124, and a third interlayer dielectric 126 are formed between the MOS FETs 130 and 140, and the first, second, and third interconnecting layers 151, 153, and 155. Here, the interlayer dielectrics 122, 124, and 126 can comprise $SiO_2$ or boron phosphorus silicate glass (BPSG). Here, a contact hole 127 is formed in the first interlayer dielectric 122 so that the first interconnecting layer 151 can be connected to sources and drains of the MOS FETs 130 and 140. In addition, a first via hole (not shown) is formed in the second interlayer dielectric 124 so that the second interconnecting layer 153 can be electrically connected to the first interconnecting layer 151, and a second via hole 137 is formed in the third interlayer dielectric 126 so that the third interconnecting layer 155 can be electrically connected to the second interconnecting layer 153.

The heaters 160 for heating the ink to generate bubbles are formed between the third interconnecting layer 155 and the third interlayer dielectric 126 on the upper portion of the power FET 140. Preferably the heaters 160 comprise TaAl, TaN, or TiN.

In addition, a passivation layer 128 is formed on the upper portion of the heater 160 and the third interconnecting layer 155. The passivation layer 128, which may comprise SiN, insulates the heater 160 from the ink, and protects the heater 160 from corrosion due to the ink.

An anti-cavitation layer 129 is formed on an upper portion of the passivation layer 128, on which the ink chamber 175 is located. The anti-cavitation layer 129 protects the heater 160 from shock generated when bubbles burst, and preferably the anti-cavitation layer 129 comprises a material having high chemical and abrasion resistance. The anti-cavitation layer 129 can comprise Ta, or Ti and TiN.

Hereinafter, a method of manufacturing the inkjet printhead according to an embodiment of the present invention will be described with reference to FIGS. 6A through 6J.

Figure 6A:
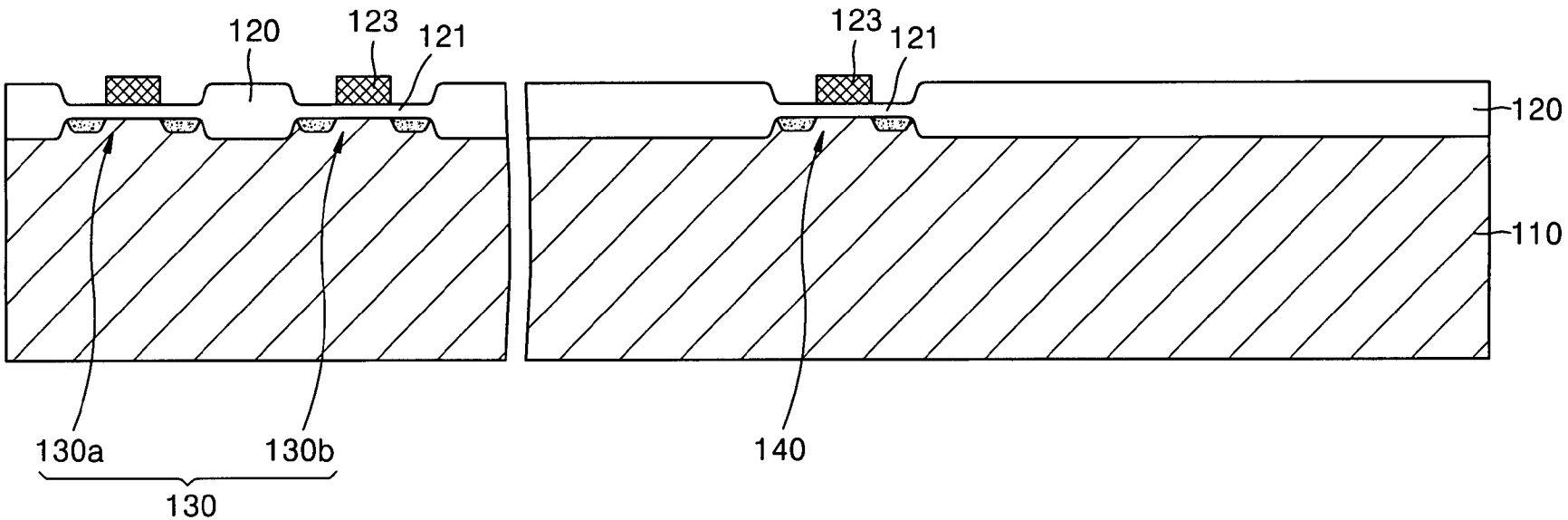
FIGS. 6A through 6J are views illustrating a method of manufacturing the inkjet printhead according to an embodiment of the present invention.

As shown in FIG. 6A, the plurality of MOS FETs 130 and 140 are formed on the substrate 110 for addressing the heaters 160 and applying electric current to the heaters 160. Specifically, the gate oxide film 121 and the field oxide film 120 are formed on the substrate 110, then the gate 123 is formed on the gate oxide film 121 and sources and drains are formed on active areas of both sides of the gate 123 to complete the MOS FETs 130 and 140. Here, the MOS FETs 130 and 140 are the CMOS FET 130 for addressing the heaters 160 and the power FET 140 for driving the heaters 160. The CMOS FET 130 includes the PMOS FET 130*a* and the NMOS FET 130*b*, and the power FET 140 includes the NMOS FET.

Figure 6B:
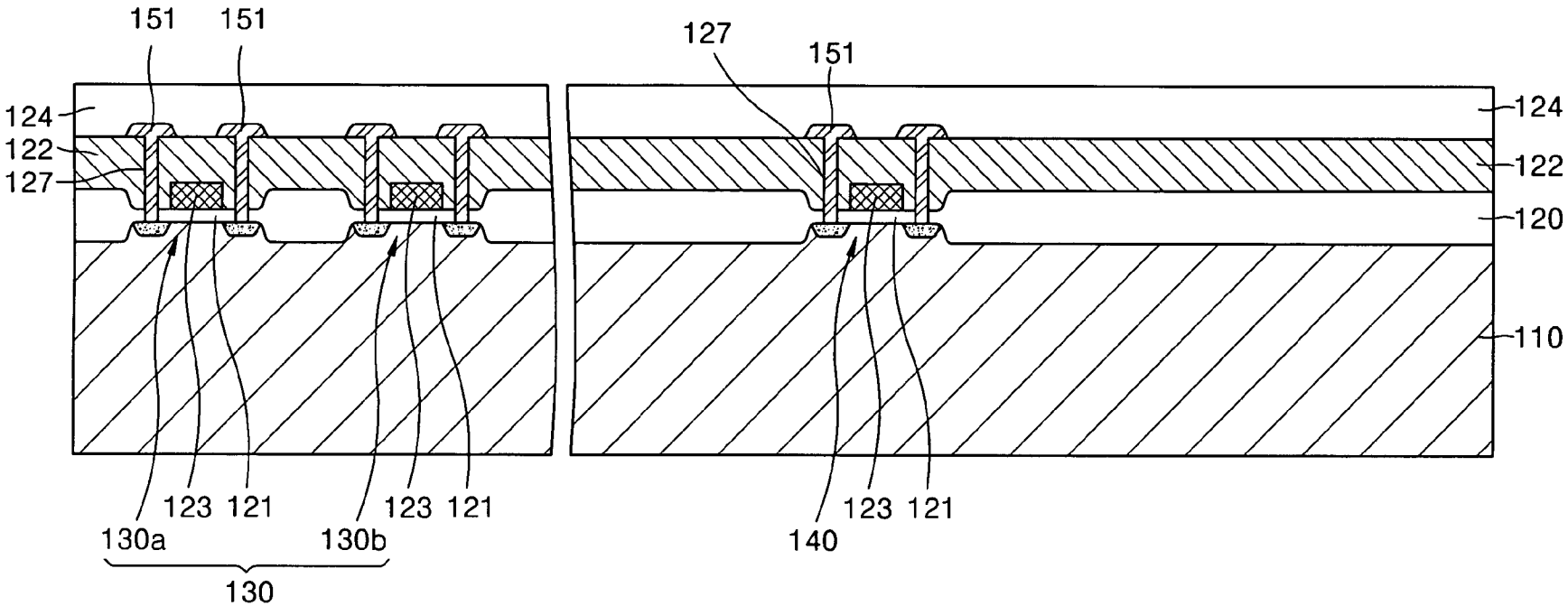

Next, as shown in FIG. 6B, the first interlayer dielectric 122, the first interconnecting layer 151, and the second interlayer dielectric 124 are sequentially formed on the MOS FETs 130 and 140. Specifically, after forming the first interlayer dielectric 122 on the MOS FETs 130 and 140, the contact hole 127 is formed in the first interlayer dielectric 122 through the photolithography process and the etching process to open the source and the drain of the MOS FETs 130 and 140. In addition, the metal material having a high electric conductivity is deposited on the first interlayer dielectric 122 so as to fill the contact hole 127, and the deposited material is patterned to form the first interconnecting layer 151. Next, the second interlayer dielectric 124 is formed on the first interconnecting layer 151. Here, the first and the second interlayer dielectrics 120 and 122 can comprise $SiO_2$ or BPSG.

Figure 6C:
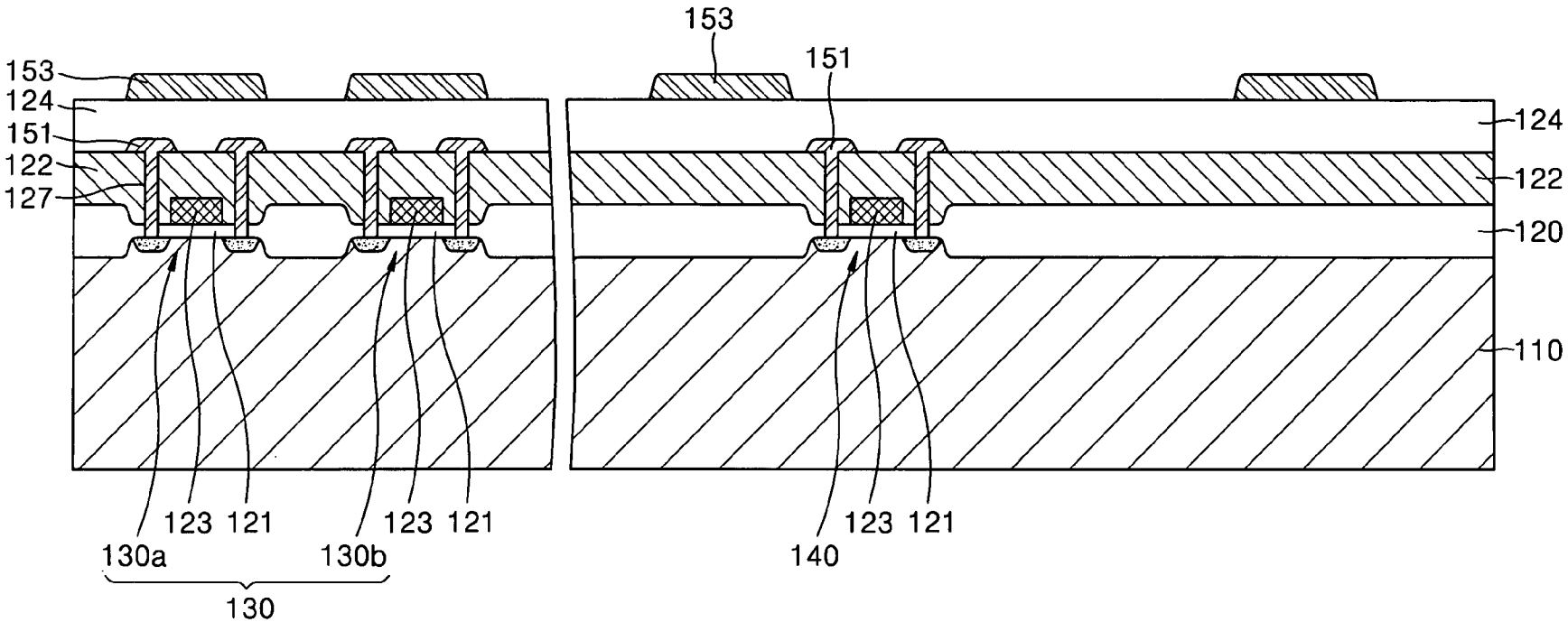

Referring to FIG. 6C, the second interconnecting layer 153 is formed on the second interlayer dielectric 122. That is, the first via hole (not shown) that exposes a part of the first interconnecting layer 151 is formed in the second interlayer dielectric 122 through the photolithography process and the etching process. Next, the metal material having a high electric conductivity is deposited on the second interlayer dielectric so that the first via hole can be filled, and the deposited layer is patterned to form the second interconnecting layer 153.

Figure 6D:
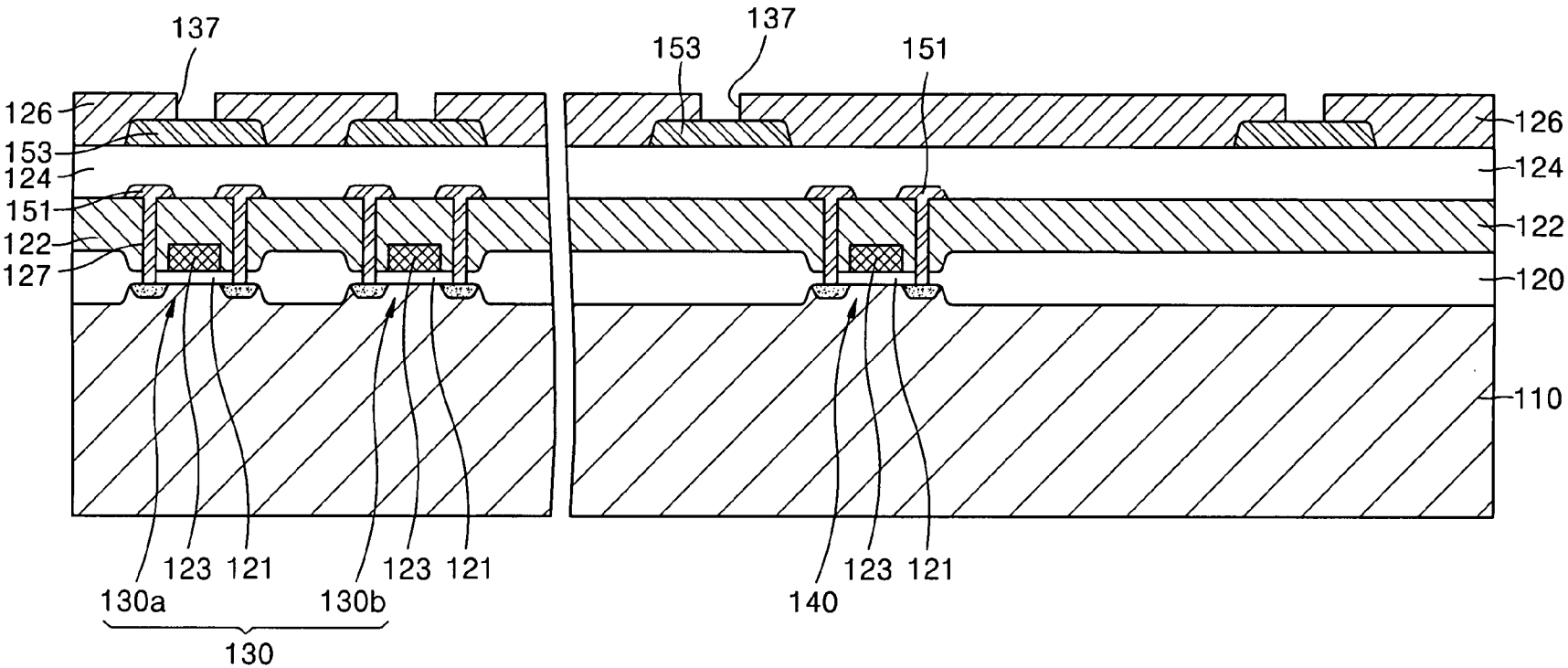

Then, as shown in FIG. 6D, the third interlayer dielectric 126 is formed on the second interconnecting layer 153, and the second via hole 137 that exposes a part of the second interconnecting layer 153 is formed in the third interlayer dielectric 126 through the photolithography process and the etching process. Here, the third interlayer dielectric 126 may comprise $SiO_2$ or BPSG.

Figure 6E:
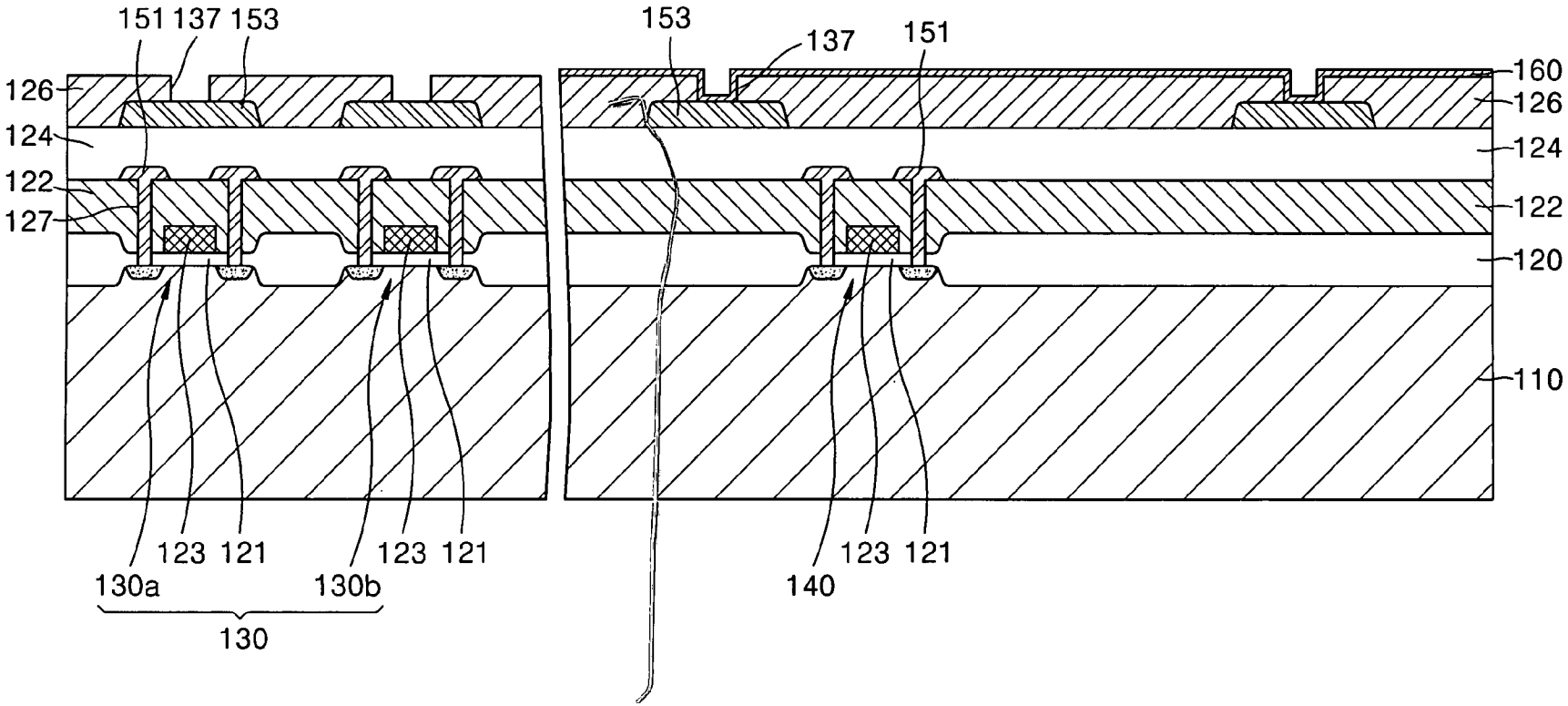

Referring to FIG. 6E, a resistive heating material is deposited on the surface of the third interlayer dielectric 126 and the surface of the second interconnecting layer 153, which is exposed by the second via hole 137, and the deposited material is patterned to form the heaters 160. Preferably, the resistive heating material comprises TaAl, TaN, or TiN.

Figure 6F:
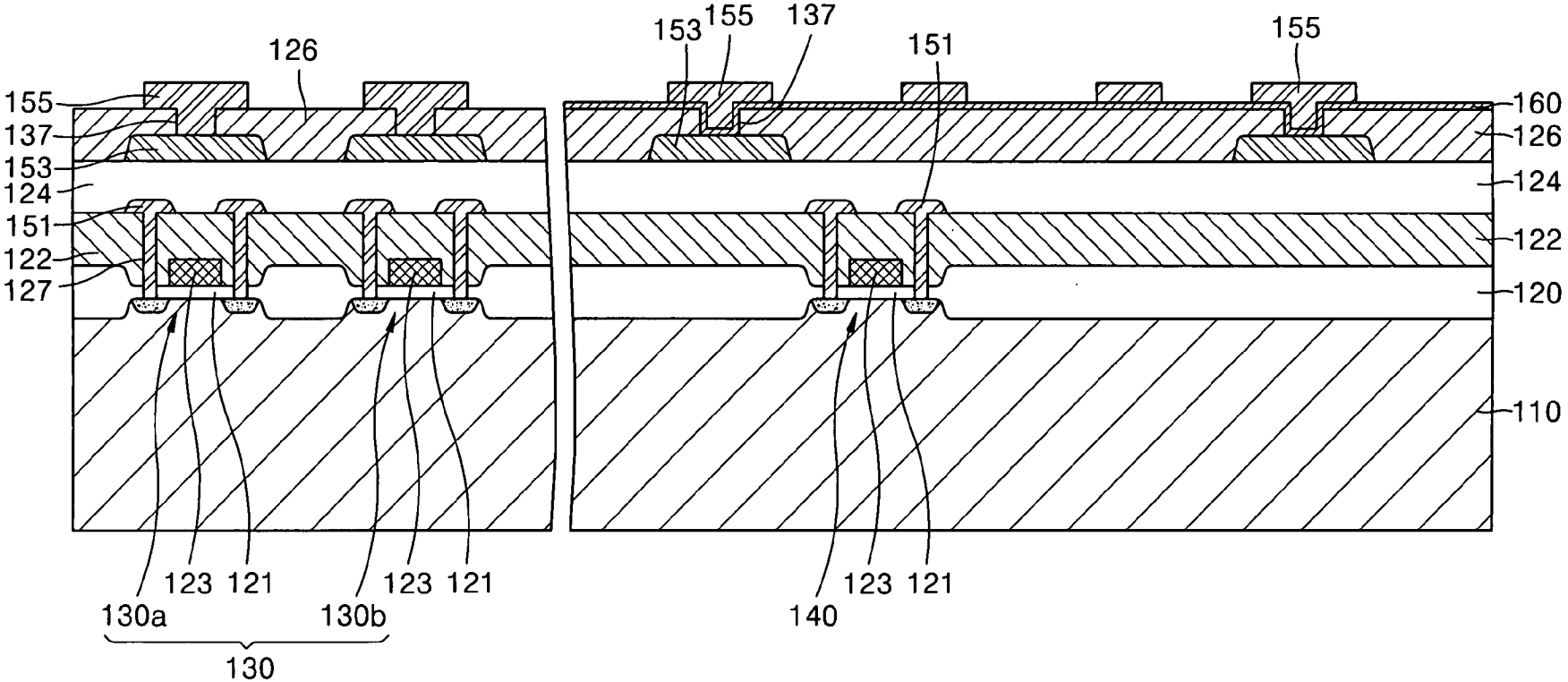

Next, as shown in FIG. 6F, the third interconnecting layer 155 is formed on the third interlayer dielectric 126 and the heaters 160. The third interconnecting layer 155 is formed by depositing a metal material having a high electric conductivity on the upper portion of the third interlayer dielectric 126 and the heaters 160 so that the second via hole 137 is filled with the material, and patterning the deposited material. Accordingly, operations of forming the digital logic circuit 1314), the heater driving circuit 141, and the heaters 160, are complete.

Figure 6G:
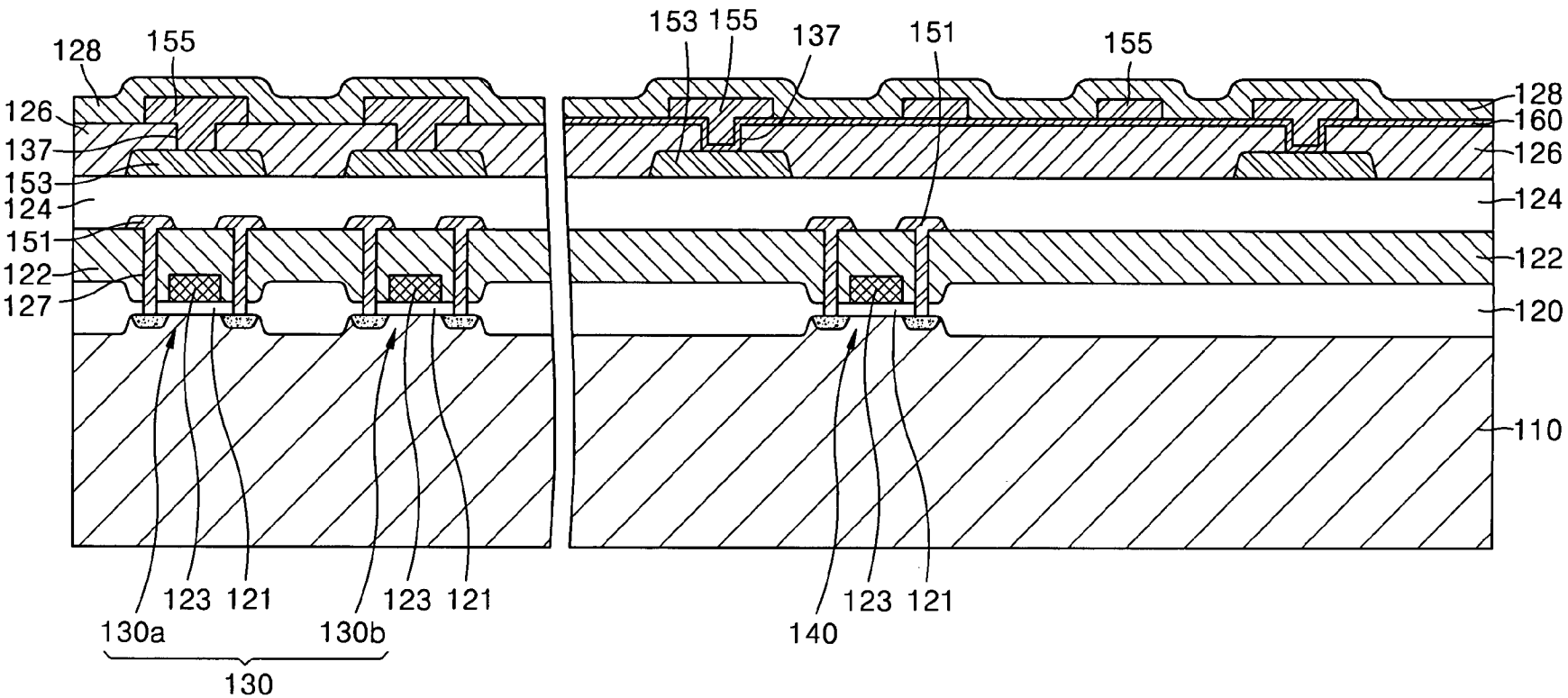

Referring to FIG. 6G, a passivation layer 128 is formed on the third interconnecting layer 155 and the heaters 160. The passivation layer 128 can be formed by depositing SiN on the third interconnecting layer 155 and the heaters 160. The passivation layer 128 insulates the heaters 160 from the ink, and prevents the heaters 160 from being corroded by the ink.

Figure 6H:
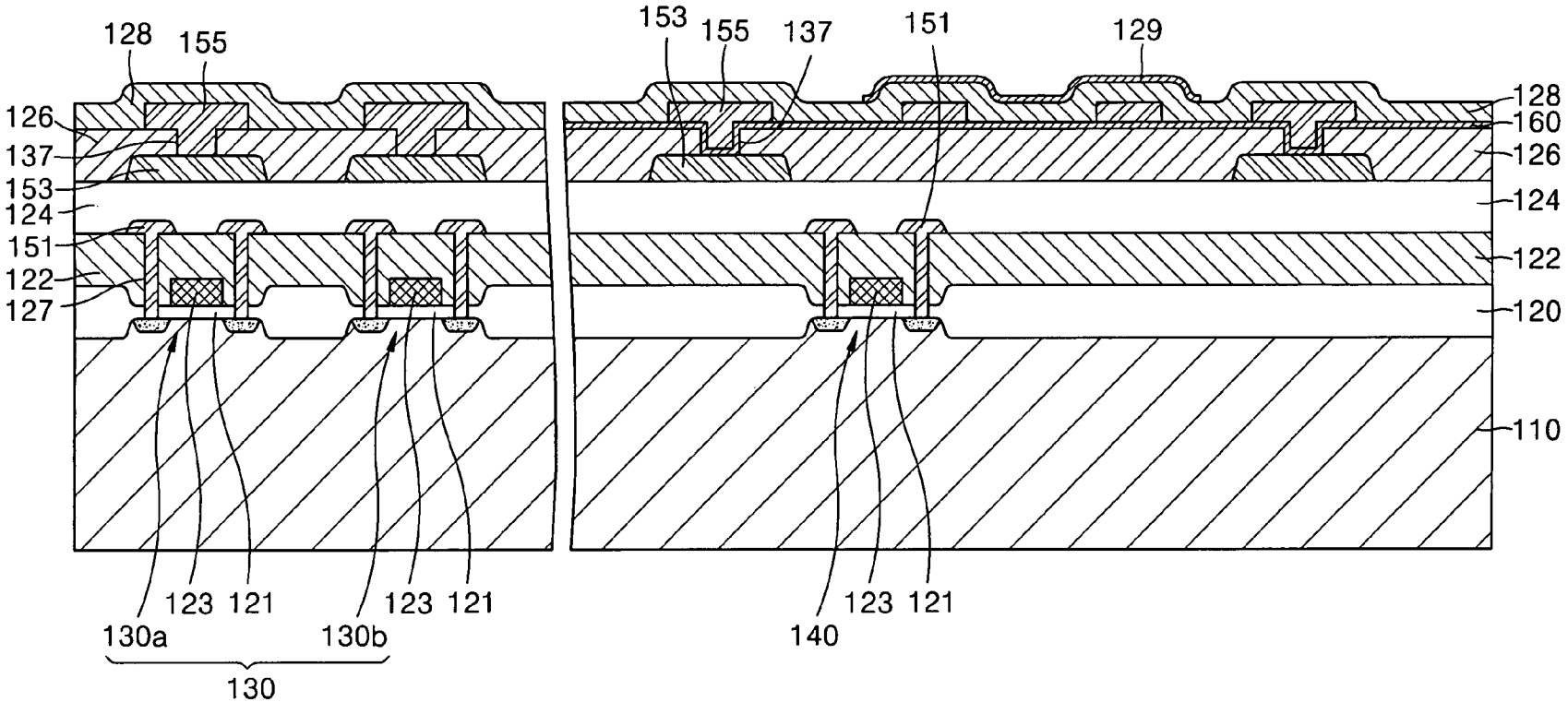

Next, as shown in FIG. 6H, the anti-cavitation layer 129 is formed on the passivation layer 129, in which the ink chamber 175 (see FIG. 6I) is located. The anti-cavitation layer 129 can be formed by depositing Ta or successively depositing Ti and TiN on the passivation layer 128, and patterning the deposited layers. The anti-cavitation layer 129 is formed to protect the heaters 160 from shock generated when the bubbles burst.

Figure 6I:
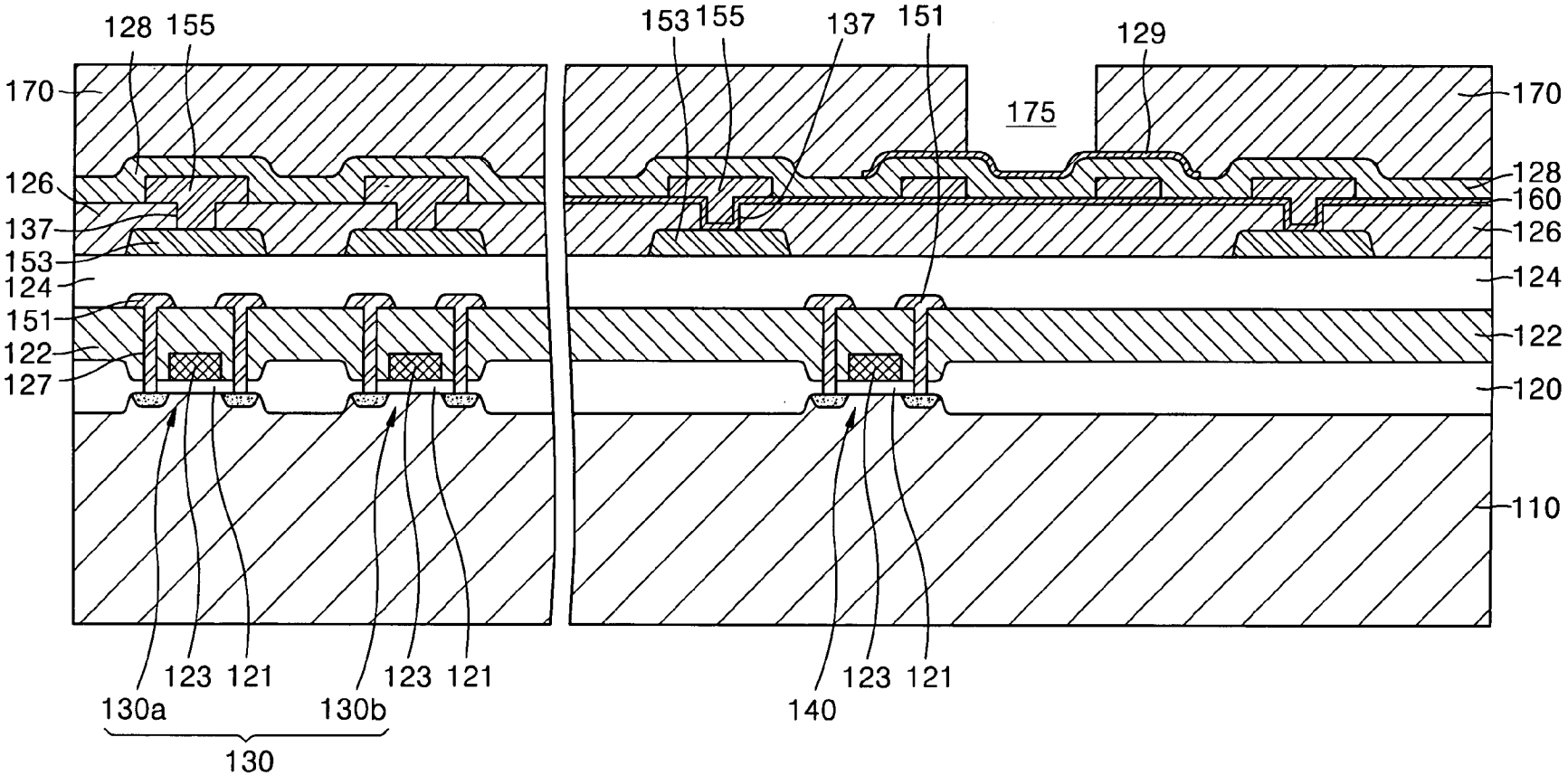
Figure 6J:
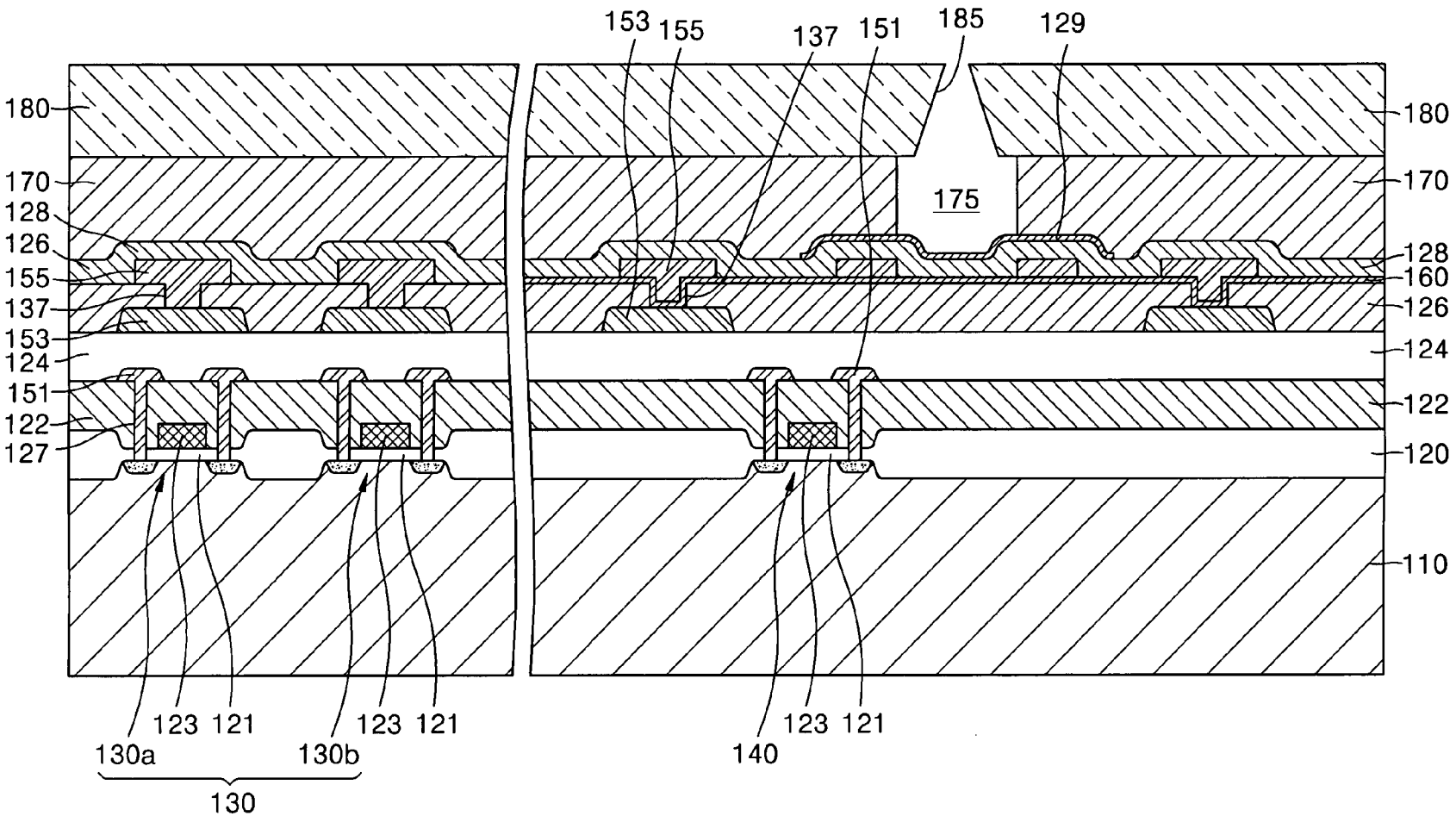

Then, as shown in FIG. 6I, a chamber layer 170 that defines the ink chamber 175, which is filled with ink, is formed on the passivation layer 128, on which the anti-cavitation layer 129 is formed. In addition, a nozzle layer 180 including the nozzle 185, through which the ink is ejected, is formed on the chamber layer 170, as shown in FIG. 6J.

As previously described, according to an embodiments of the present invention, the digital logic circuit and the heater driving circuit are formed using three metal interconnecting layers, thus the size of the printhead chip can be minimized. In addition, since the lengths of the wires are reduced, the circuit signal transmission speed can be improved.

While the present invention has been particularly shown and described with reference to exemplary embodiments thereof, it should be understood by those of ordinary skill in the art that various changes in form and details may be made therein without departing from the spirit and scope of the present invention as defined by the following claims.

What is claimed is:

1. An inkjet printhead comprising:

a substrate;

a plurality of heaters formed on an upper portion of the substrate for heating ink for generating bubbles;

a plurality of metal-oxide semiconductor (MOS) field effect transistors (FETs) formed on the substrate for addressing the heaters and applying electric current to the heaters;

a first interconnecting layer, a second interconnecting layer, and a third interconnecting layer that are sequentially formed on the MOS FETs and electrically connected to each other for applying signals to the MOS FETs;

a chamber layer for defining an ink chamber, which is filled with ink that will be ejected, on an upper portion of the heaters; and a nozzle layer having a nozzle, through which the ink is ejected, on an upper portion of the chamber layer;

wherein the heaters are formed on a lower surface of the third interconnecting layer comprising a top interconnecting layer.

2. The inkjet printhead of claim 1, wherein first, second, and third interlayer dielectrics are formed between the MOS FETs, and the first, the second, and the third interconnecting layers.

3. The inkjet printhead of claim 2, wherein the first, second, and third interlayer dielectrics comprise $SiO_2$ or boron phosphorous silicate glass.

4. The inkjet printhead of claim 2, wherein the heaters are formed between the third interconnecting layer and the third interlayer dielectric.

5. The inkjet printhead of claim 1, wherein the heaters comprise TaAl, TaN, or TiN.

6. The inkjet printhead of claim 1, wherein a passivation layer is formed on upper surfaces of the heaters and the third interconnecting layer.

7. The inkjet printhead of claim 6, wherein the passivation layer comprises SiN.

8. The inkjet printhead of claim 6, wherein an anti-cavitation layer is formed on an upper surface of the passivation layer, on which the ink chamber is located.

9. The inkjet printhead of claim 8, wherein the anti-cavitation layer comprises Ta.

10. The inkjet printhead of claim 8, wherein the anti-cavitation layer comprises Ti and TiN.

* * * * *